US012037148B2

(12) United States Patent
Oppici et al.

(10) Patent No.: US 12,037,148 B2
(45) Date of Patent: Jul. 16, 2024

(54) MACHINE FOR UNWINDING AND REWINDING A COVERING TAPE INTENDED FOR THE STABILISATION OF PALLETISED LOADS

(71) Applicant: A.C.M.I.—SOCIETA' PER AZIONI, Fornovo di Taro (IT)

(72) Inventors: Giorgio Oppici, Rubbiano di Solignano (IT); Giacomo Magri, Beduzzo (IT)

(73) Assignee: A.C.M.I.—SOCIETA' PER AZIONI, Fornovo di Taro (IT)

( * ) Notice: Subject to any disclaimer, the term of this patent is extended or adjusted under 35 U.S.C. 154(b) by 78 days.

(21) Appl. No.: 17/736,356

(22) Filed: May 4, 2022

(65) Prior Publication Data

US 2022/0355957 A1 Nov. 10, 2022

(30) Foreign Application Priority Data

May 7, 2021 (IT) ..... 102021000011741

(51) Int. Cl.
*B65B 11/02* (2006.01)
*B65B 11/58* (2006.01)

(52) U.S. Cl.
CPC ..... *B65B 11/025* (2013.01); *B65B 11/585* (2013.01); *B65B 2210/18* (2013.01)

(58) Field of Classification Search
CPC .. B65B 11/025; B65B 11/585; B65B 2210/18
USPC ..... 53/397
See application file for complete search history.

(56) References Cited

U.S. PATENT DOCUMENTS 4,266,735 A * 5/1981 Leanna ..... B65H 19/305 242/534
4,516,742 A * 5/1985 Townsend ..... B65H 18/04 242/533.5
4,883,233 A * 11/1989 Saukkonen ..... B65H 18/26 242/541.5
5,909,856 A * 6/1999 Myer ..... B65H 19/2238 242/533.6
2005/0193687 A1 9/2005 Tosa
2006/0254225 A1 11/2006 Lancaster et al.
2020/0407089 A1 12/2020 Jones

FOREIGN PATENT DOCUMENTS

EP 0845412 A1 6/1998
WO 2008059359 A2 5/2008

* cited by examiner

*Primary Examiner* — Robert F Long
*Assistant Examiner* — Xavier A Madison
(74) *Attorney, Agent, or Firm* — Browdy and Neimark, PLLC

(57) ABSTRACT

A machine for unwinding and rewinding a covering tape (800) includes a first support shaft to coaxially receive a reel of covering tape, a second support shaft, parallel to and distanced from the first support shaft, which is adapted to coaxially receive a tubular support, a motor adapted to put the second support shaft in rotation around its own axis, a plurality of contrast rollers arranged around the second support shaft and oriented parallel thereto, and a movement apparatus adapted to move the contrast rollers towards and away from the axis of the second support shaft.

16 Claims, 8 Drawing Sheets

MACHINE FOR UNWINDING AND REWINDING A COVERING TAPE INTENDED FOR THE STABILISATION OF PALLETISED LOADS

FIELD OF THE ART

The present invention relates to a machine adapted to unwind a covering tape from a starting reel, generally of large size, and to rewind it into smaller reels adapted to be used on winding machines for stabilising palletised loads.

BACKGROUND ART

As is well known, a palletised load generally comprises a pallet, for example made of wood, plastic or other material, and one or more loads arranged on top of said pallet.

One way to stabilise these palletised loads is to wrap them with a covering tape. The machines designed to perform this wrapping operation generally comprise a functional arrangement (also called working head), on which a reel of covering tape is installed.

A first end of the covering tape is made integral with the palletised load, after which the functional arrangement is engaged in a relative motion of revolution around the palletised load and in a simultaneous motion of translation in the vertical direction.

In this way, the combination of the relative motion of revolution and of the relative motion of translation makes it possible to unwind the covering tape from the reel that is installed on the functional arrangement and to wind it spirally around the palletised load.

Traditionally, the covering tape is made of a stretchable plastic film but, in order to reduce the environmental impact of this type of packaging, winding machines capable of wrapping palletised loads with a covering tape consisting of a cellulose-based material, such as paper, have recently been proposed.

However, this type of covering tape is supplied by the manufacturers in the form of reels having generally large sizes (up to 1.2 metres in diameter) and a correspondingly very high weight, which are not particularly suitable to be mounted on the functional arrangement of a winding machine, as their weight and their inertia would considerably complicate the apparatuses necessary to move them with precision and rapidity around the palletised load.

For this reason, it is advisable that winding machines for palletised loads use smaller and lighter reels of covering tape, which however are not a production standard and whose purchase would therefore entail higher costs.

DISCLOSURE OF THE INVENTION

In view of the foregoing, an object of the present invention is to make available a machine capable of unwinding a covering tape from a large sized reel and rewinding it into a plurality of smaller reels that can be effectively used on winding machines for palletised loads.

Another object of the present invention is to perform this task quickly, accurately and with a high degree of automation.

These and other objects are reached thanks to the characteristics of the invention as set forth in the independent claims. The dependent claims outline preferred and/or particularly advantageous aspects of the invention but not strictly necessary for the implementation thereof.

In particular, an embodiment of the present invention makes available a machine for unwinding and rewinding a covering tape, comprising at least:

- a first support shaft adapted to receive coaxially a reel of covering tape,
- a second support shaft, parallel to and distanced from the first support shaft, which is adapted to coaxially receive a tubular support,
- a motor adapted to put the second support shaft in rotation around its own axis,
- a plurality of contrast rollers arranged around the second support shaft and oriented parallel thereto, and
- a movement apparatus adapted to move the contrast rollers towards and away from the axis of the second support shaft.

Thanks to this solution, the tubular support can be fitted onto the second support shaft when the contrast rollers are distanced from the axis thereof.

Subsequently, the free end of the covering tape of the reel may be made to advance towards a space comprised between the axis of the second support shaft and at least one of the contrast rollers, so that it is fitted between the latter and the tubular support.

At this point, the contrast rollers may be brought closer to the axis of the second support shaft, until the free end of the covering tape of the reel is clamped between the tubular support and said at least one contrast roller.

By putting the second support shaft in rotation, the tubular support is also dragged in rotation and with it the covering tape, which then unwinds from the reel and rewinds on the tubular support, progressively forming a new reel on it.

As the covering tape winds onto the tubular support, the contrast rollers may be moved away from the axis of the second support shaft, so as to allow the new reel to increase while keeping the windings compact.

Once a reel having the desired size has been obtained, the covering tape can be cut, so as to separate the reel placed on the first support shaft from the one placed on the second support shaft, which can be finally removed and replaced by a new tubular support to repeat the previous operations.

From what has been described above, it is clear that, thanks to the machine described above, it is advantageously possible to obtain a plurality of reels of covering tape from a single reel of larger size, in a simple, fast and highly automated way.

According to one aspect of the invention, the contrast rollers may be equidistant with respect to the axis of the second support shaft.

In this way, the contrast rollers are all tangent to an imaginary cylinder coaxial with the second support shaft, forming a sort of cage surrounding the tubular support.

According to another aspect of the invention, the machine may particularly comprise:

- a first pair of said contrast rollers, which are arranged symmetrically between them with respect to a first plane of symmetry containing the axis of the second support shaft, and
- a second pair of said contrast rollers, which are arranged symmetrically to the contrast rollers of the first pair with respect to a second plane of symmetry containing the axis of the second support shaft and orthogonal to the first plane of symmetry.

In this way, the four contrast rollers are substantially arranged at the corners of an (imaginary) rectangular parallelepiped containing the axis of the second support shaft, providing an optimal support to the tubular support and to the turns of covering tape that are progressively wound on it.

Another aspect of the invention envisages that the movement apparatus may comprise:

- a first frame adapted to carry at least one of said contrast rollers,
- a second frame adapted to carry the remaining contrast rollers, and
- actuation members to move said first frame and said second frame in opposite directions along a same sliding direction orthogonal to the axis of the second support shaft.

Thanks to this solution, the movement apparatus is particularly simple and reliable.

In particular, if the machine comprises the two pairs of contrast rollers mentioned above, it is preferable that the first pair of contrast rollers be carried by the first frame, that the second pair of contrast rollers be carried by the second frame, and that the sliding direction of the two frames be parallel to the first plane of symmetry.

In this way, during the movement of the frames, the contrast rollers of each pair are always kept equidistant from the axis of the second support shaft.

According to a different aspect of the invention, the machine may comprise a motor adapted to put the first support shaft in rotation around its own axis. Thanks to this solution, by appropriately controlling the speed of the motor driving the first support shaft and the speed of the motor driving the second support shaft, it is advantageously possible to keep the covering tape at the right tension during its transfer from the reel to the tubular support.

In this respect, another aspect of the invention provides that the machine may comprise a plurality of return rollers oriented parallel to the first support shaft for guiding the covering tape between the reel and the tubular support, at least one of which is associated with at least one force sensor (e.g., a load cell) adapted to measure the force exerted on it by the covering tape.

In this way, by measuring the force that is discharged on this return roller, it is advantageously possible to measure the tension of the covering tape and, based on this, to adjust the speed of the first and second support shaft so as to keep it within optimal values.

A too low tension may cause the covering tape to be wound too loosely around the tubular substrate, while a too high tension may cause the covering tape to yield, damaging it or causing it to lose important strength characteristics.

According to another aspect of the invention, at least one of the return rollers, for example the same to which the force sensor is associated, may be grooved by two helical channels extending from a central stretch of the roller towards the opposite axial ends thereof with opposite helical directions.

Thanks to these two helical channels, the covering tape that comes into contact with this return roller is stretched laterally, preventing it from forming wrinkles. Another aspect of the present invention provides that the machine may comprise a curved body adapted to stay in contact with the covering tape unwinding from the reel, for example in a stretch comprised between two return rollers, which has two opposite axial ends aligned along a common axis parallel to the axis of the first support shaft, and a central portion misaligned with respect to said common axis.

In other words, this curved body, which may be defined for example by a tube, has the effect of counteracting any displacement of the covering tape in a direction parallel to the axis of the first support shaft, keeping it coplanar to the reel even during the transfer onto the tubular support.

According to one aspect of the invention, the machine may further comprise a cutting device for separating the covering tape from the reel.

In this way, the segment of covering tape that is rewound on the tubular support can be separated from that still wound on the initial reel, allowing the removal of the new reel obtained and the subsequent forming of other reels.

In particular, the cutting device may comprise at least:

- a blade,
- a blocking device operatively positioned between the blade and the first support shaft, to selectively block the covering tape unwinding from the reel, and
- actuator members adapted to move said blade transversely with respect to the covering tape.

This aspect provides a particularly simple and efficient solution for making the cutting device.

Another aspect of the invention provides that the machine may comprise an actuation device for unwinding the covering tape from the reel and making it advance towards the second support shaft.

Thanks to this actuation device, which can be put into operation after each cutting operation, the unwinding arrangement is advantageously able to partially unwind the covering tape from the reel installed on the first support shaft and advance its free end towards the second support shaft so that it can be clamped between the tubular support (empty) and at least one contrast roller.

In particular, the actuation device may comprise:

- a motorised drive roller having a rotation axis parallel to the axis of the second support shaft,
- a contrast roller having a rotation axis parallel to the rotation axis of the drive roller, and
- actuator members adapted to create a relative movement of said drive roller and said contrast roller transversally with respect to the respective rotation axes between a distanced configuration, in which between the drive roller and the contrast roller a gap is defined, adapted to be crossed with clearance by the covering tape unwinding from the reel, and a neared configuration, in which the drive roller and the contrast roller are adapted to clamp said covering tape.

In this way, when the free end of the covering tape has already been blocked on the tubular support, the contrast roller and the drive roller can be brought into a distanced position, leaving the unwinding and rewinding of the covering tape to be controlled by the rotation of the first and second support shaft.

When, on the other hand, the covering tape has been cut and its free end needs to be advanced towards the second support shaft, the contrast roller and the drive roller are brought into a neared configuration so that the rotation of the drive roller causes the covering tape to advance.

In order to guide the free end of the support tape during this advancement step towards the second support shaft, an aspect of the invention provides that the machine may comprise one or more blower devices adapted to emit jets of air into a space comprised between the first and second support shaft to keep the free end of the covering tape stretched and oriented in a predetermined manner.

As anticipated above, the invention finally makes available a method for un-winding and rewinding a covering tape by means of the machine outlined above, which generally comprises the steps of:

- fitting a reel of covering tape coaxially onto the first support shaft, fitting a tubular support coaxially onto the second support shaft, fitting one free end of the covering tape of the reel between the tubular support and at least one of the contrast rollers, bringing the contrast rollers closer to the axis of the second support shaft, so as to tighten said free end against the tubular support, putting the second support shaft in rotation, and progressively moving the contrast rollers away from the axis of the second support shaft.

BRIEF DESCRIPTION OF THE FIGURES

Further characteristics and advantages of the invention will become clear from reading the following description provided by way of non-limiting example, with the aid of the figures illustrated in the accompanying tables.

Figure 5:
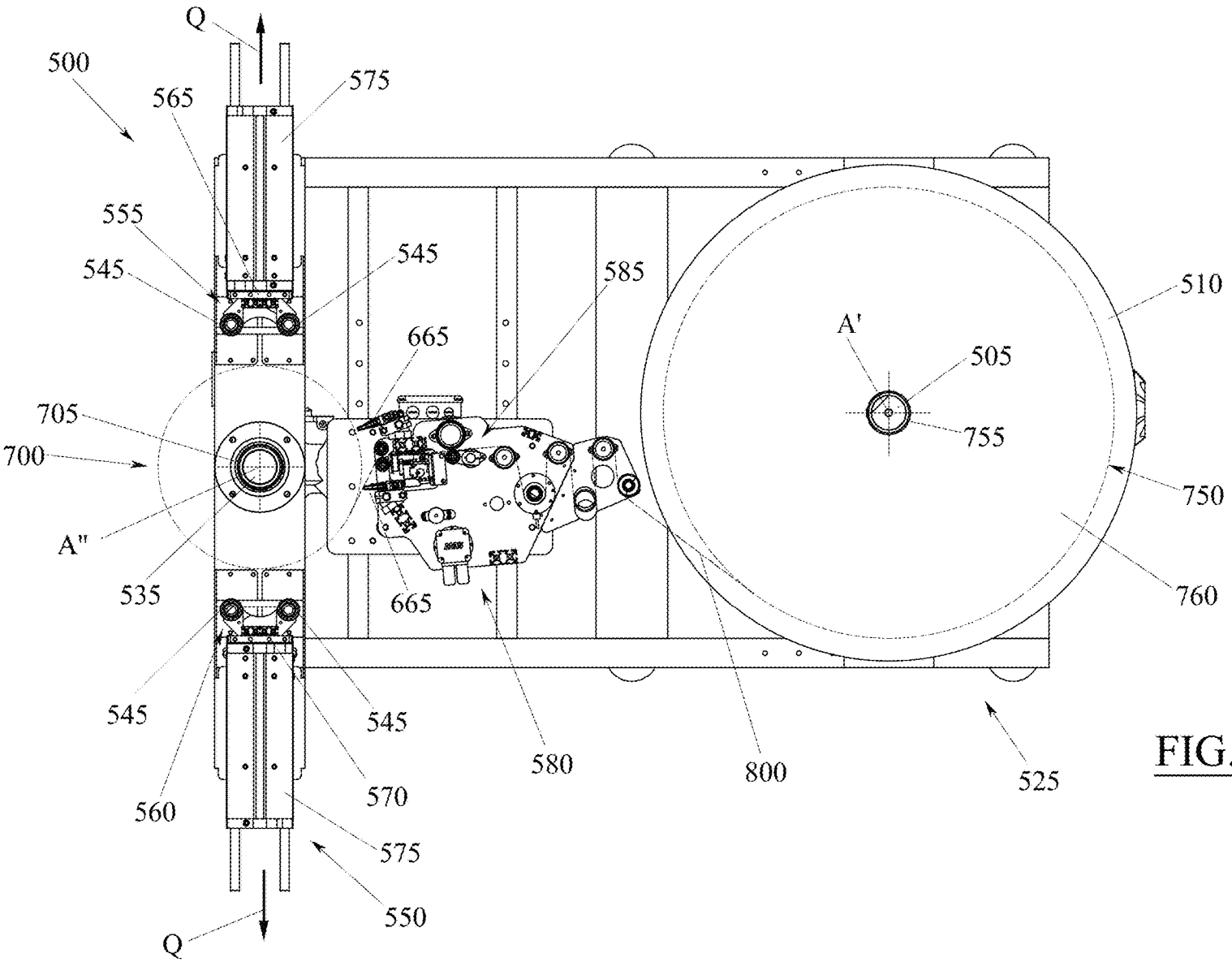
FIG. 5 is the section V-V indicated in FIG. 4.

Figures from 9 to 12 are an enlarged detail of FIG. 5 shown in various operating configurations.

DETAILED DESCRIPTION

Figure 1:
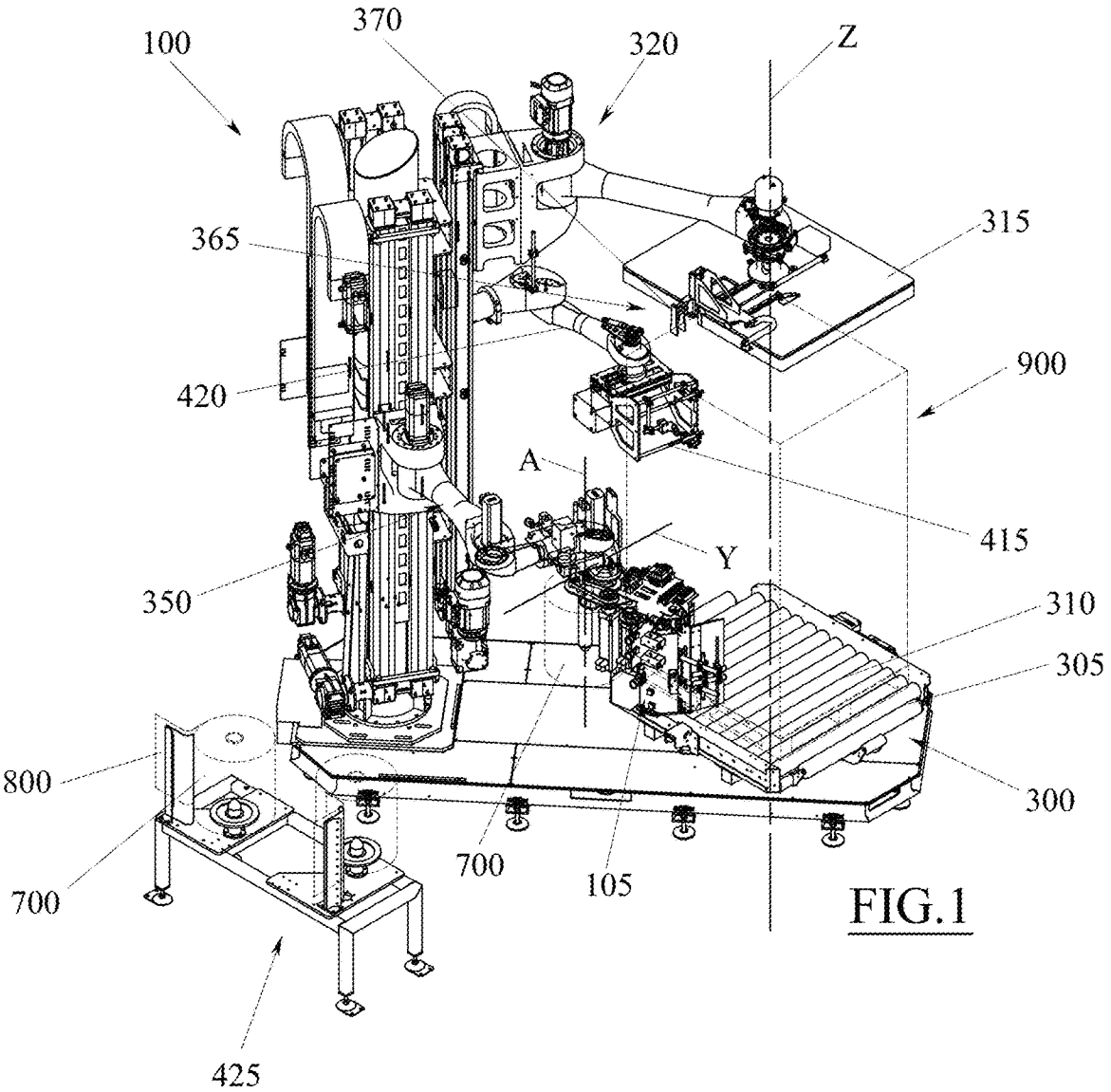
FIG. 1 is an axonometric view of a machine for stabilising palletised loads.
Figure 2:
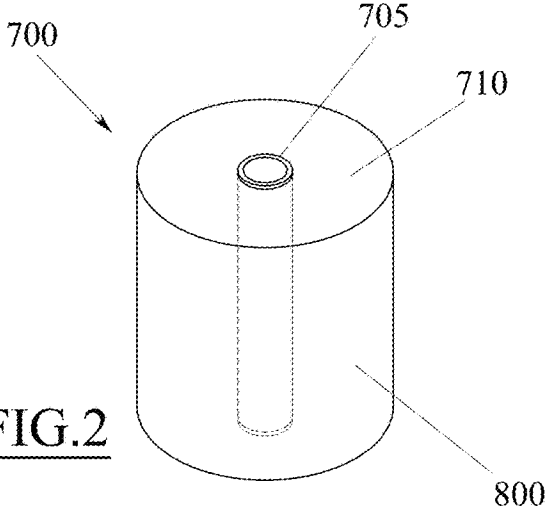
FIG. 2 is an axonometric view of a reel of covering tape adapted to be mounted on the functional arrangement of the machine of FIG. 1.

FIG. 1 illustrates a winding machine 100 configured to stabilise palletised loads 900 by wrapping with a covering tape 800.

The covering tape 800 may be made from a cellulose-based material, such as paper, or from any other recyclable and/or biodegradable and/or compostable material.

By virtue of its nature, the covering tape 800 may be generally inextensible.

The winding machine 100 generally comprises a functional arrangement 105 (or operating head), which is adapted to carry a reel 700 of the covering tape 800.

In particular, the reel 700 may comprise a tubular support 705, preferably cylindrical, on which the covering tape 800 is wound so as to form a roll 710.

The axis of this roll 710, i.e., the winding axis of the covering tape 800 around the tubular support 705, is generally coincident with the axis of the tubular support 705.

The tubular support 705 may be made of cardboard, metal, plastic or any other suitable material.

This reel 700 is rotatably associated with the functional arrangement 105, so as to be adapted to rotate on itself around a predetermined rotation axis A which generally coincides with the winding axis of the covering tape 800, that is with the support axis 705.

Further, the winding machine 100 can comprise a first movement apparatus 300 adapted to produce a relative motion of revolution of the functional arrangement 105 around the palletised load 900, with respect to a predetermined, preferably vertical, revolution axis Z.

For example, the first movement apparatus 300 may comprise a platform 305, which makes available a rest surface 310, preferably horizontal, for the palletised load 900, and actuator members (not illustrated) adapted to put the platform 305 in rotation around a rotation axis orthogonal to the rest surface 310 and coincident with the revolution axis Z, for example substantially vertical.

In a position superimposed on the rest surface 310, the winding machine 100 can comprise an upper pad 315, which is adapted to stay in contact with the top of the palletised load 900.

This upper pad 315 can be substantially shaped as a flat plate, for example substantially rectangular/square in shape, and oriented horizontally.

The upper pad 315 can be associated with a lifting apparatus 320 adapted to move it in the vertical direction, so as to bring it closer to and away from the rest surface 310, for example to free the palletised load 900 or to adjust the position thereof.

The upper pad 315 can also be adapted to rotate on itself around a vertical rotation axis, which is coincident (or can be brought so as to be coincident) with the revolution axis Z.

In particular, it is preferable that the rotation of the upper pad 315 occurs substantially simultaneously and substantially at the same speed as the rotation of the platform 305, so that the palletised load 900 is not subjected to significant torsional stresses.

Although reference has been made to a first movement apparatus 300 adapted to rotate the palletised load 900, it is not excluded that, in other embodiments, the palletised load 900 may remain stationary, for example resting on a rest surface 310 made available by a floor or any other fixed base, and that the first movement apparatus 300 is configured to actively move the functional arrangement 105 with a revolution movement around the palletised load 900.

Regardless of these considerations, the winding machine 100 further comprises a second movement apparatus 350, which is adapted to produce a relative motion of translation of the functional arrangement 105 with respect to the palletised load 900, along a direction parallel to the revolution axis Z, or preferably in the vertical direction.

The second movement apparatus 350 is preferably configured to also allow a variation in the orientation of the functional arrangement 105, and consequently of the rotation axis A of the reel 700, by rotation around a further oscillation axis Y perpendicular to the revolution axis Z, that is preferably horizontal.

For example, the second movement apparatus may be conformed as a SCARA robot provided with an articulated arm at the end of which the functional arrangement 105 is carried.

In particular, the functional arrangement 105 can be connected to the arm of the SCARA robot through a further articulated joint defining the aforementioned oscillation axis Y.

The winding machine 100 further comprises a gripping device 365, which is adapted to seize a first free end of the covering tape 800 unwinding from the reel 700 of the functional arrangement 105, to make it integral with the palletised load 900.

This gripping device 365 may be installed on board the upper pad 315.

However, it is not excluded that, in other embodiments, the gripping device 365 may be positioned at the base of the palletised load 900, for example on board the platform 305.

This gripping device 365 can comprise a gripper member 370 provided with at least two jaws that are reciprocally movable towards and away from each other, so as to be able to selectively tighten or release an edge of the covering tape 800 which is positioned between them.

In addition to what has been described so far, the winding machine 100 further comprises a fixing device (not illustrated), which is adapted to fix the windings of covering tape 800 around the palletised load 900.

This fixing device can comprise one or more guns for dispensing an adhesive adapted to be applied on the windings of the covering tape 800.

However, it is not excluded that, in other embodiments, the fixing device may comprise nail guns, staple guns, banding machines or any other device for applying an element, a substance or a treatment that allows to join and/or hold together the windings of covering tape 800.

In any case, the fixing device may be installed directly on board the functional arrangement 105 or on an independent frame 415, which may in turn be associated with a third movement apparatus 420, for example with a further SCARA robot.

The operation of the winding machine 100 provides that the palletised load 900 is loaded onto the rest surface 310 and the upper pad 315 is brought into contact with the top thereof, possibly causing it to exert a certain downward pressure.

While the palletised load 900 is stationary in this position, the functional arrangement 105 may be brought in proximity to the palletised load 900 and at the gripping device 365, such that the latter may seize and hold a first (free) end of the covering tape 800 associated with the reel 700.

At this point, the platform 305 and the upper pad 315 can be put in rotation around the revolution axis Z, by actuating the rotation of the palletised load 900 as well.

In this way, the reel 700 which is on board the functional arrangement 105 begins to perform a relative revolution movement around the palletised load 900.

During this revolution movement, since the first end of the covering tape 800 remains integral with the palletised load 900, the covering tape 800 is automatically dragged so as to unwind from the reel 700 and to wind around the palletised load 900.

Thereafter, while the palletised load 900 continues to rotate, the second movement apparatus 350 can begin to displace the functional arrangement 105 in a vertical direction.

In this way, the covering tape 800 is wound around the palletised load 900 with a spiral course, until it completely covers the side wall.

Obviously, should the gripping device 365 be placed on the platform 305, the winding of the palletised load would take place in the opposite direction from the bottom to the top.

In any case, at the end of winding, the platform 305 and the upper pad 315 may be stopped.

The fixing device may then fix the last stretch of the covering tape 800 coming from the reel 700 against the palletised load 900, before a cutting device, mounted on board the functional arrangement 105, separates the segment of covering tape 800 wound around the palletised load 900 from the one that remains connected to the reel 700.

Subsequently, the palletised load 900 wrapped with the covering tape 800 may be moved away and replaced by another palletised load 900 to be stabilised. When the covering tape 800 of the reel 700 has run out, the reel should be removed and replaced.

For this purpose, the winding machine 100 can be equipped with a magazine 425 in which one or more reels 700 of covering tape 800 adapted to be mounted on the functional arrangement 105, for example through a fully automatic procedure, can be prepared.

Figure 3:
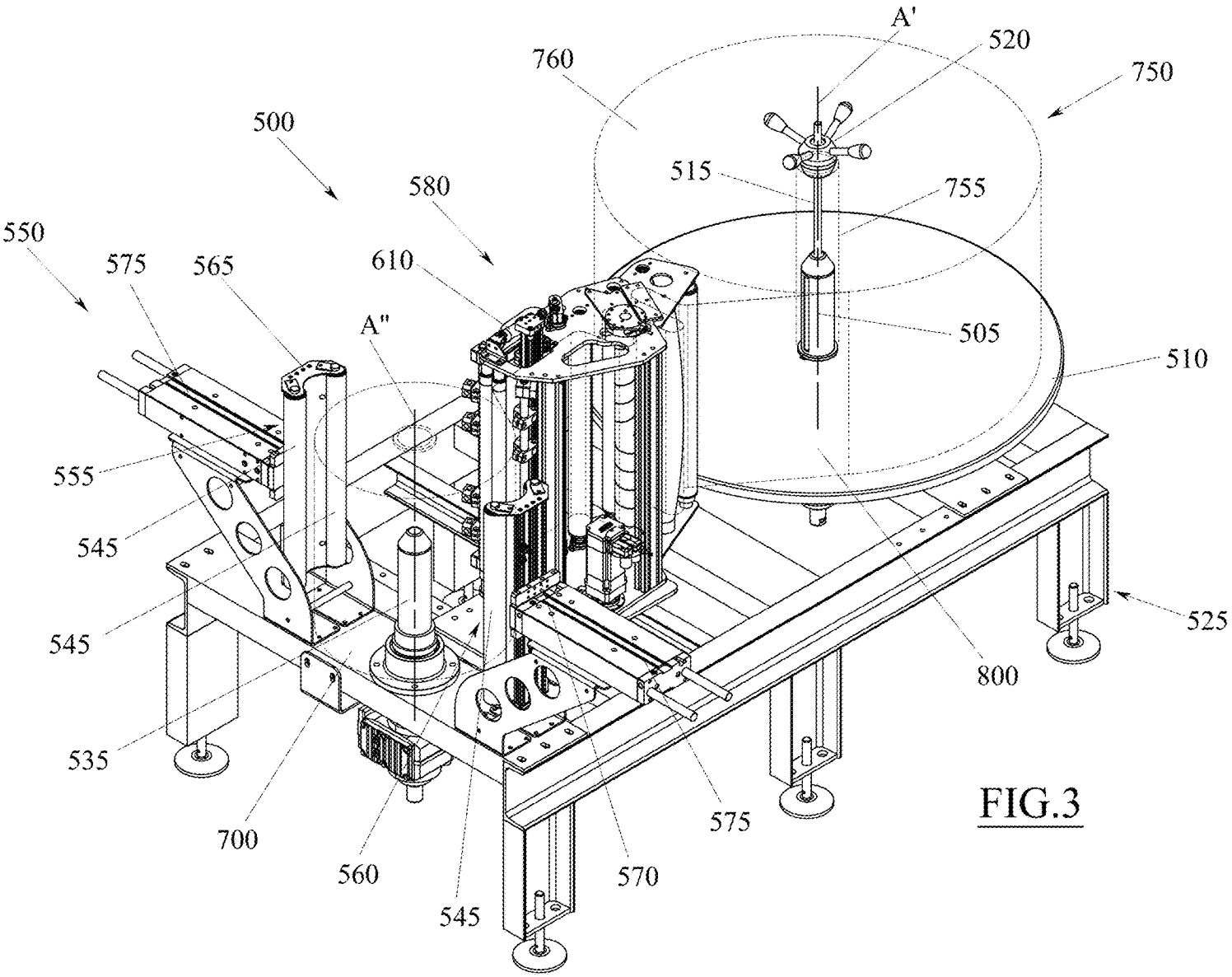
FIG. 3 is an axonometric view of a machine for unwinding and rewinding a covering tape according to an embodiment of the present invention.
Figure 4:
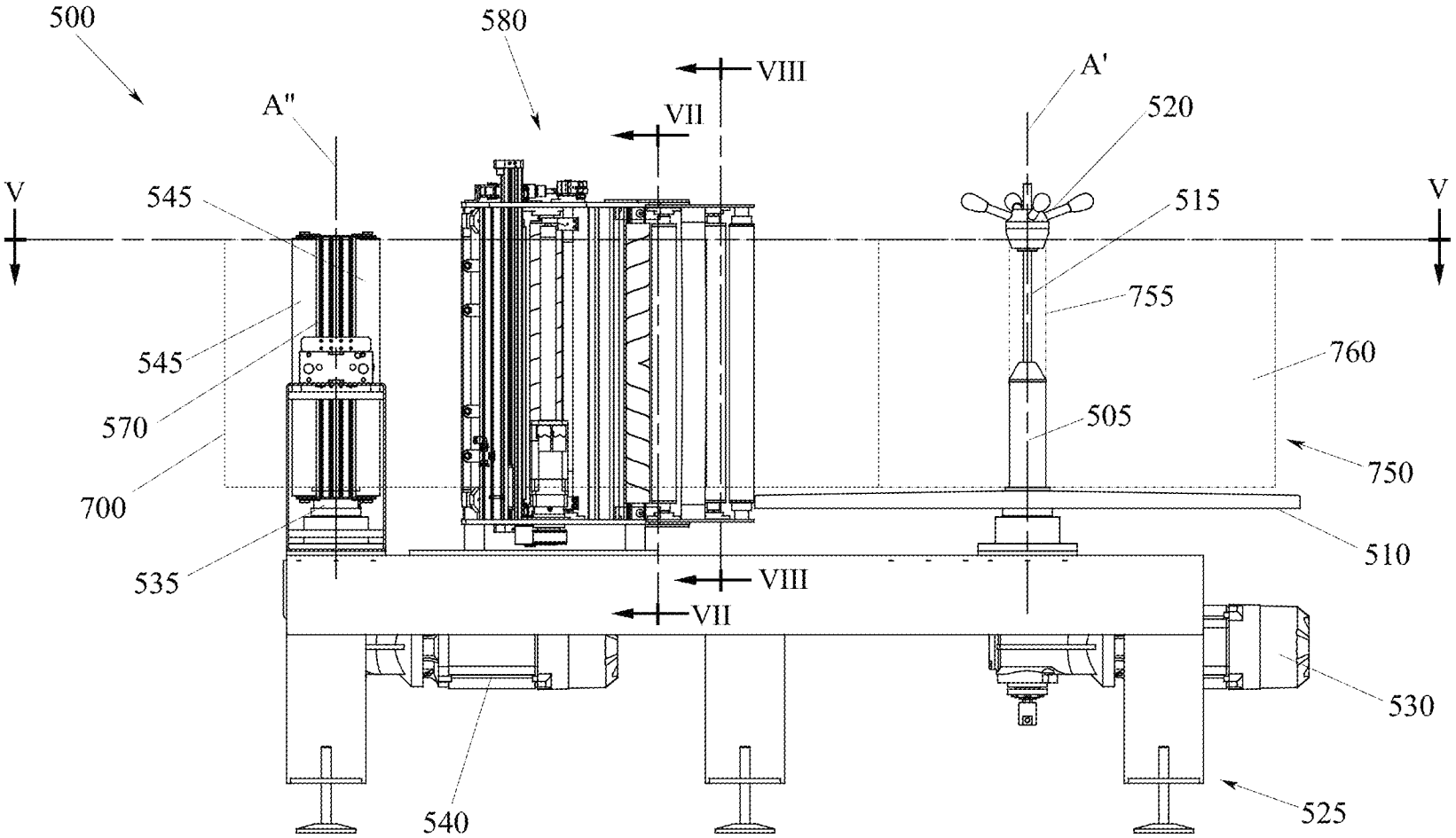
FIG. 4 is a side view of the machine of FIG. 3.

The reels 700 of covering tape 800 may in turn be made by a special reeling machine 500, an embodiment of which is illustrated in FIG. 3.

This machine 500 is adapted to make the reels 700 starting from a reel 750 having (much) larger sizes, as is typically supplied by the manufacturer of the covering tape 800.

In particular, the reel 750 may also comprise a tubular support 755, preferably cylindrical, on which the covering tape 800 is wound so as to form a roll 760. The axis of this roll 760, i.e., the winding axis of the covering tape 800 around the tubular support 755, is generally coincident with the axis of the tubular support 755.

The tubular support 755 may be made of cardboard, metal, plastic or any other suitable material.

The tubular support 755 may have substantially the same axial extension and/or diameter as the tubular support 705 of the reels 700, i.e., the tubular supports 755 and 705 may be substantially identical.

Returning to the machine 500, it may comprise a first support shaft 505, on which the reel 750, i.e., its tubular support 755, is coaxially fitted.

This first support shaft 505 may be vertically oriented and may protrude cantilevered from a substantially horizontal rest platform 510, which may be adapted to support the reel 750.

The first support shaft 505 may be an expandable shaft, for example of a mechanical and/or pneumatic type, which is adapted to vary its own outer diameter from a minimum value to a maximum value.

The minimum diameter of the first support shaft 505 is generally less than or equal to the inner diameter of the tubular support 755 of the reel 750, whereas the maximum diameter is potentially greater than said inner diameter.

In this way, when the first support shaft 505 is in the minimum diameter configuration, the same can be fitted into the tubular support 755 of the reel 750, after which it can be driven towards the maximum diameter configuration, so as to firmly block said tubular support 755 resulting integral with the reel 750. It should be noted herein that the first support shaft 505 may not be a perfectly cylindrical body, or at least may not be a perfectly cylindrical body when in the maximum diameter configuration.

For example, the first support shaft 505 may have a cylindrical body and longitudinal ribs or fins arranged radially about the axis of the cylindrical body, which are movable in a radial direction by effect of the activation of suitable actuator members.

In this way, when the first support shaft 505 is in a minimum diameter configuration, said longitudinal ribs may be contained within or flush therewith, while, when the first support shaft 505 is in a maximum diameter configuration, said ribs may protrude with respect to the cylindrical body, causing it to assume a shape assimilable to that of a splined shaft, for example.

However, in each of the above-mentioned configurations, the diameter of the first support shaft 505 is generally to be considered as the diameter of the smallest ideal cylinder suitable for circumscribing the first support shaft 505 in that configuration.

In the illustrated embodiment, the axial extension of the first support shaft 505, starting from the rest platform 510 is significantly less than the extension of the tubular support 755 of the reel 750.

Therefore, in order to more firmly block the reel 750, the first support shaft 505 may be provided with a threaded rod 515 that rises from its free end and protrudes outside the tubular support 755, to receive by screwing a ring nut 520 adapted to axially tighten the tubular support 755 of the reel 750 towards the rest platform 510.

The first support shaft 505, and with it the rest platform 510, may be rotatably associated with a load-bearing structure 525 of the machine 500, so as to be adapted to rotate on itself around its own central axis A'.

Such rotation may be driven by a motor 530, typically electric, for example through a suitable transmission system.

The machine 500 further comprises a second support shaft 535, whose central axis A" is parallel to and distanced from the axis A' of the first support shaft 505.

The second support shaft 535 is arranged so that a tubular support 705 (without covering tape), on which to make a reel 700, can be coaxially fitted onto it.

In this regard, this second support shaft 535 may also be mounted cantilevered onto the machine 500, for example onto the load-bearing structure 525 thereof, where it may face in the same direction as the first support shaft 505, i.e., upwards.

The second support shaft 535 is preferably an expandable shaft, for example of a mechanical and/or pneumatic type, substantially of the same type as described for the first support shaft 505, such that it can be made integral with the tubular support 705.

The second support shaft 535 may further be rotatably associated with the load-bearing structure 525 of the machine 500, such that it is adapted to rotate on itself around its own axis A".

Such rotation may be driven by a motor 540, preferably electric, for example through a suitable transmission system.

The motor 540 is preferably independent of the motor 530, so that the first support shaft 505 and the second support shaft 535 can be driven at different speeds.

Around the second support shaft 535, the machine 500 comprises a plurality of contrast rollers 545 having axes parallel to each other and parallel to the axis A" of the second support shaft 535.

These contrast rollers 545 may all have the same diameter and possibly the same axial extension.

Each contrast roller 545 may be adapted to rotate on itself about its own axis, preferably in an idle mode.

The contrast rollers 545 are associated with a movement apparatus, generically indicated with 550, which is adapted to move each of them towards and away from the central axis A" of the second support shaft 535, for example along a direction substantially orthogonal to the axis A".

Figure 10:
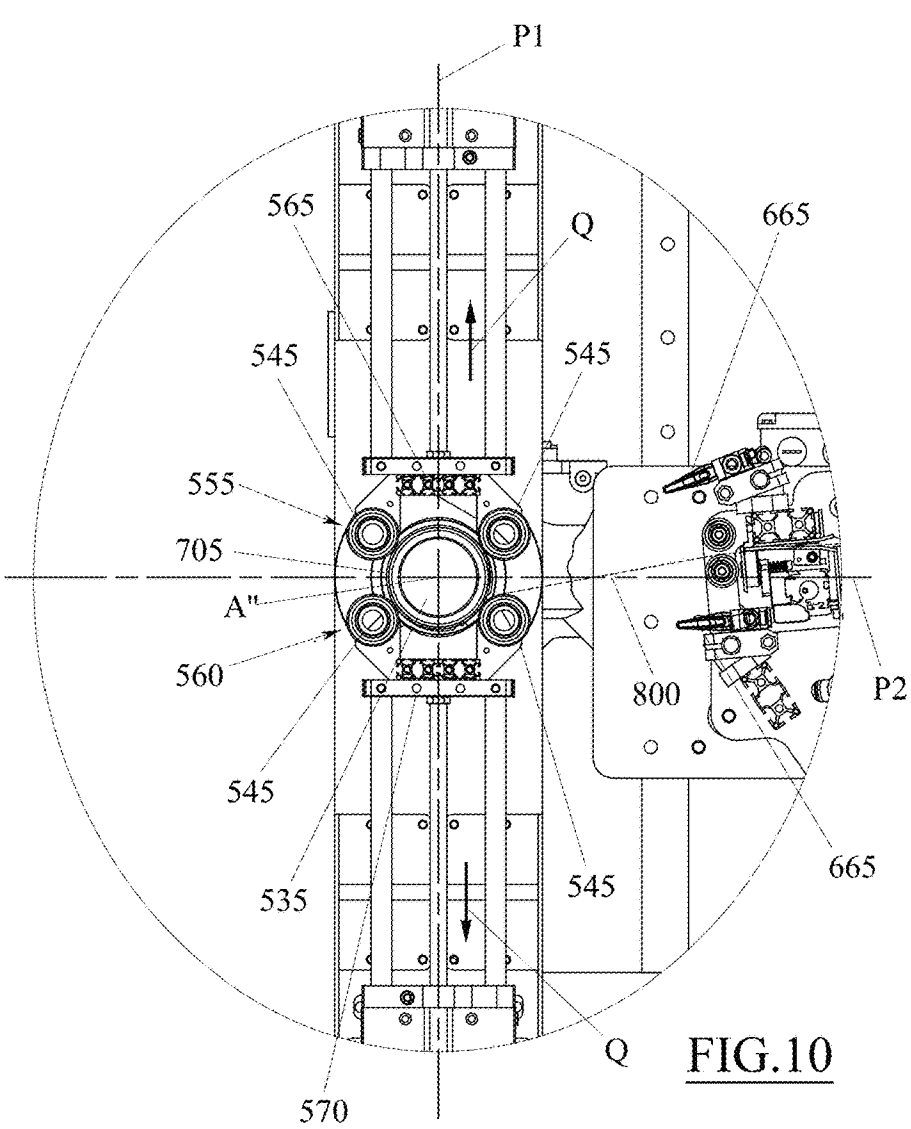

In particular, the movement apparatus 550 is adapted to bring all the contrast rollers 545 closer to the axis A" of the second support shaft 535 until a neared configuration illustrated in FIG. 10 is reached.

This neared configuration may represent an extreme configuration, beyond which the contrast rollers 545 cannot be further approached to the axis A" but only moved away.

In this neared configuration, the contrast rollers 545 are all at the same distance from the axis A", such that they are substantially tangent to a same imaginary cylinder coaxial to the second support shaft 535.

In particular, the distance between the axis A" and each contrast roller 545 in a neared configuration, i.e., the radius of the aforesaid imaginary cylinder, is substantially equal to the external radius of the tubular support 705 or slightly greater, preferably however not exceeding the sum of said radius and the thickness of the covering tape 800.

In this way, the contrast rollers 545 in a neared configuration are substantially in contact or nearly in contact with the tubular support 705 which is fitted onto the second support shaft 535.

Entering into more details, the embodiment illustrated in the figures provides that the machine comprises at least two pairs of the aforesaid contrast rollers 545 (i.e., four contrast rollers 545 altogether), of which a first pair 555 and a second pair 560.

As can be observed in FIG. 10, at least when they are in the neared configuration, the contrast rollers 545 of the first pair 555 are arranged symmetrically between them with respect to a first plane of symmetry P1 containing the axis A" of the second support shaft 535, and are further symmetrically arranged with respect to the contrast rollers 545 of the second pair 560 with respect to a second plane of symmetry P2 containing the axis A" but orthogonal to the first plane of symmetry P1.

In practice, the four contrast rollers 545 are positioned at the lateral corners of an (imaginary) rectangular parallelepiped which contains the second support shaft 535 and whose diagonals pass through the axis A" of the latter.

Figure 11:
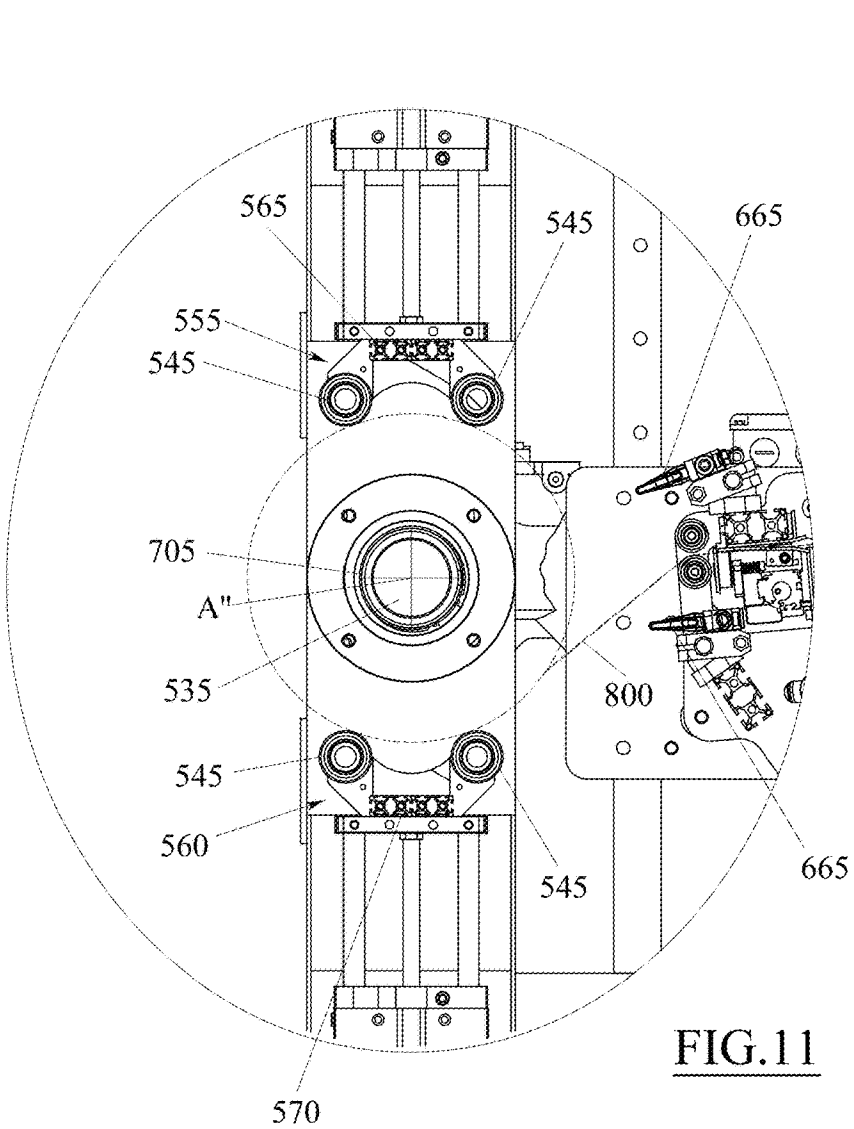

Starting from this neared configuration, the movement apparatus 550 may be adapted to move away the first and second pair 555 and 560 of contrast rollers 545 with respect to the second support shaft 535, moving them in opposite directions but along a same sliding direction Q perpendicular to the axis A" and parallel to the first plane of symmetry P1 (see, for example, FIG. 10 and FIG. 11 for comparison).

In this way, by making the two pairs 555 and 560 perform synchronous displacements at the same speed, it is advantageously possible to keep the contrast rollers 545 constantly equidistant from the axis A" of the second support shaft 535, that is, to keep them constantly tangent to a same imaginary cylinder coaxial with the second support shaft 535.

Figure 12:
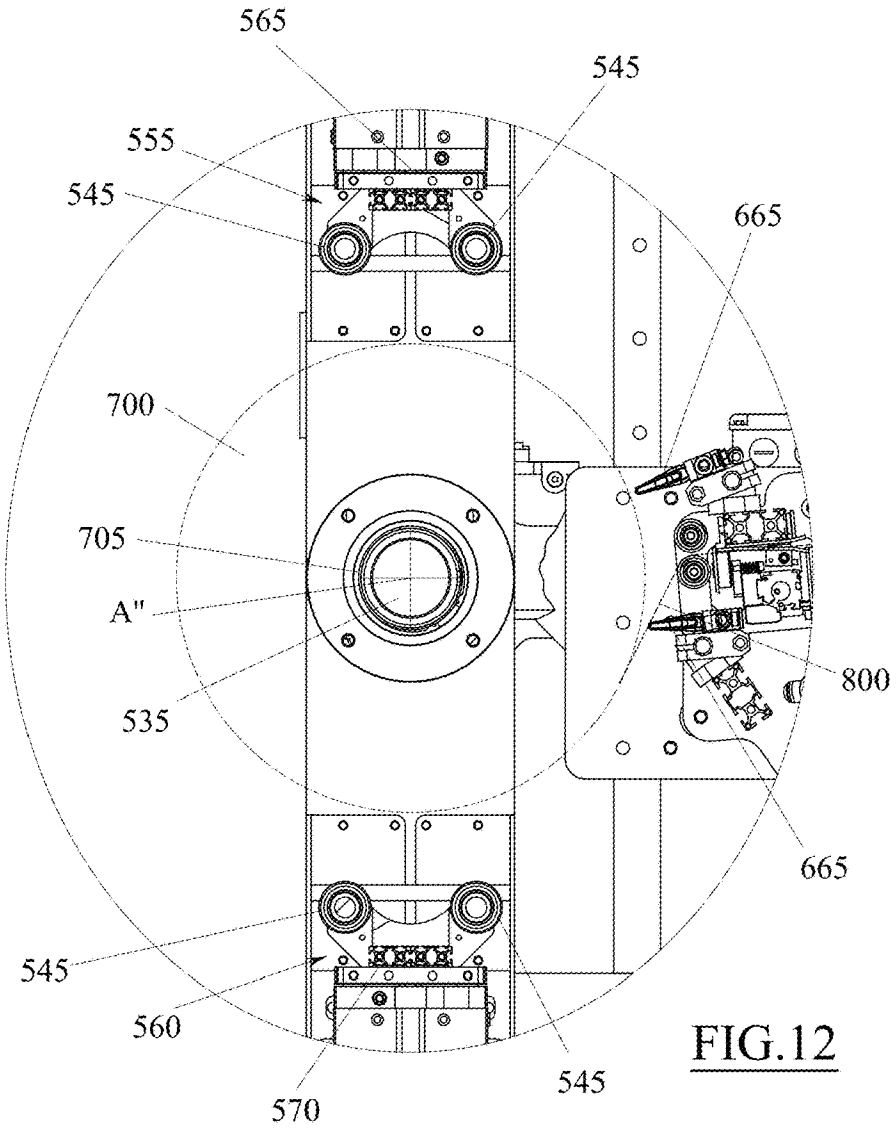

This away-movement may continue until a distanced configuration illustrated in FIG. 12 is reached, in which the contrast rollers 545 are at the maximum possible distance from the axis A".

In order to allow this type of displacements, the already mentioned movement apparatus 550 may comprise a first support frame 565 adapted to carry the contrast rollers 545 of the first pair 555 and a second support frame 570 adapted to carry the contrast rollers 545 of the second pair 560.

In other words, the contrast rollers 545 of the first pair 555 are both rotatably associated with the first support frame 565, while the contrast rollers 545 of the second pair 560 are both rotatably associated with the second support frame 570. The movement apparatus 550 further comprises actuator members adapted to move each of said first and second support frame 565 and 570 in mutually opposite directions in the sliding direction Q.

These actuator members may comprise, for example, at least two pneumatic jacks 575, which are installed on the load-bearing structure 525 of the machine 500 and are individually adapted to move a respective support frame 565 or 570. Obviously, the pneumatic jacks 575 could be replaced by any other actuator, such as an electromechanical type.

The machine 500 further comprises an unwinding arrangement 580 adapted to guide the covering tape 800 from the reel 750 towards the tubular support 705 which is mounted on the second support shaft 535, so as to create the roll 710 thereon.

The unwinding arrangement 580 may be generally adapted to engage the covering tape 800 unwinding from the reel 750 to perform a predetermined path, along which the generatrices of the covering tape 800 are maintained parallel to the rotation axis A' of the first support shaft 505, starting from an entry zone, generally facing the first support shaft 505, towards an exit zone, generally facing the second support shaft 535.

Figure 6:
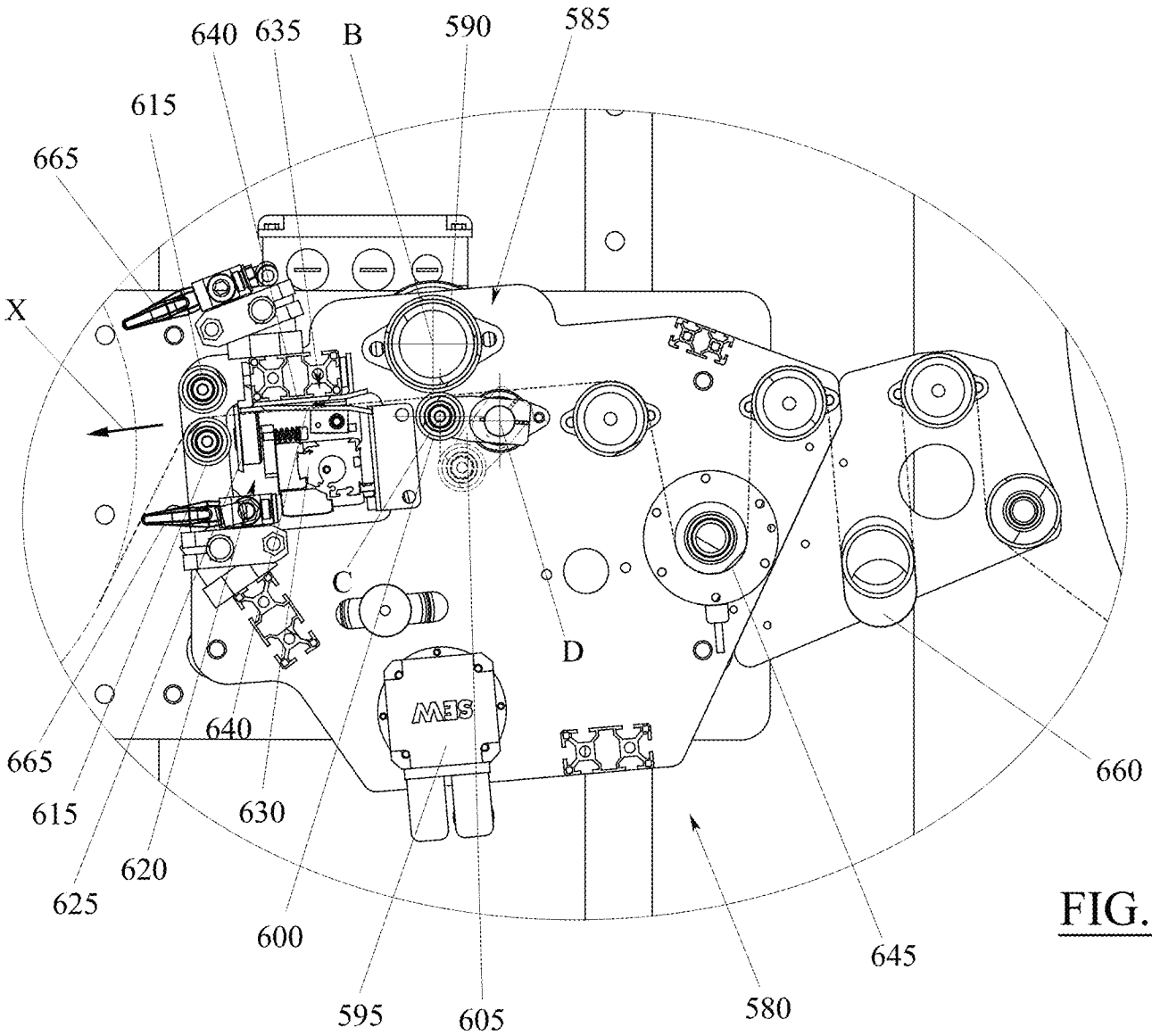
FIG. 6 is an enlarged detail of FIG. 5.

As illustrated in the detail of FIG. 6, at this exit zone, the unwinding arrangement 580 is adapted to engage the covering tape 800 to slide along a predetermined advancement direction X towards the second support shaft 535.

In particular, this advancement direction X may be substantially rectilinear and orthogonal to the rotation axis A" of the second support shaft 535.

In order to impose this advancement direction X on the covering tape 800, the unwinding arrangement 580 may comprise an actuation device 585, which may be operatively positioned between the first support shaft 505 on which the reel 750 is mounted and the second support shaft 535 on which the tubular support 705 is mounted.

Operatively positioned means that the actuation device 585 acts on a stretch of the covering tape 800 between the first support shaft 505 (i.e., the reel 750) and the second support shaft 535 (i.e., the tubular support 705).

This actuation device 585 can comprise a drive roller 590 adapted to receive the covering tape 800 in contact, and a motor 595 adapted to put the drive roller 590 in rotation around its own central axis B.

This motor 595 may be connected to the drive roller 590 by means of a suitable transmission system, for example by means of a belt drive system.

The central axis B of the drive roller 590 is preferably parallel to the rotation axis A" of the second support shaft 535.

The actuation device 585 can further comprise a contrast roller 600, which is adapted to rotate on itself (typically in an idle mode) around its own central axis C, and is adapted to press the covering tape 800 against the drive roller 590.

The central axis C of the contrast roller 600 is preferably parallel to the central axis B of the drive roller 590.

The actuation device 585 can also comprise actuator members adapted to engage the drive roller 590 and the contrast roller 600 in a relative movement, for example in a direction transverse to the respective central axes B and C, between a distanced configuration and a neared configuration.

When the drive roller 590 and the contrast roller 600 are in a distanced configuration (represented in a dotted line in FIG. 6), a gap is defined between them, through which the covering tape 800 can slide and pass freely.

When, on the other hand, the drive roller 590 and the contrast roller 600 are in a neared configuration (as represented in FIG. 6 with a continuous line), the covering tape 800 is stably blocked and tightened between these two rollers, so that the sliding thereof in the advancement direction X is generated by the rotation of the drive roller 590.

This relative movement between the distanced position and the neared position can be obtained by keeping the drive roller 590 stationary and by moving only the contrast roller 600 towards/away from the drive roller 590.

For example, the contrast roller 600 may be rotatably coupled to at least one lever 605, which is rotatably coupled to the unwinding arrangement 580, for example to a structural frame thereof, such that it is adapted to rotate around a rotation axis D parallel to but distanced from the central axis C of the contrast roller 600 and the central axis B of the drive roller 590.

By making the lever 605 rotate around the rotation axis D, the actuator members are therefore capable of moving the contrast roller 600 towards/away from the drive roller 590.

These actuator members can comprise for example a cylinder/piston arrangement 610 of the pneumatic type (see FIG. 3) or any other device suitable for the purpose, for example of the electromechanical type.

Although a solution has been described in which it is the contrast roller 600 that is displaced with respect to the drive roller 590, it is not excluded that, in other embodiments, it is the drive roller 590 that is actively displaced with respect to the contrast roller 600.

In order to guide the covering tape 800, the unwinding arrangement 580 may further comprise a pair of support rollers 615, having axes parallel to each other and parallel to the rotation axis A" of the second support shaft 535, which are separated by a narrow gap within which the covering tape 800 may slide freely but with reduced clearance.

This gap is preferably aligned along the advancement direction X with the gap that remains defined between the drive roller 590 and the contrast roller 600 of the actuation device 585, when the same are in a distanced position.

In particular, the support rollers 615 may be operatively positioned downstream of the actuation device 585, that is, between the actuation device 585 and the second support shaft 535.

Operatively positioned means that the support rollers 615 are adapted to operate on a stretch of the covering tape 800 comprised between the actuation device 585 and the second support shaft 535 (i.e., the tubular support 705).

Each of these support rollers 615 may further be rotatably coupled to the un-winding arrangement 580, for example to a load-bearing frame thereof, so as to be adapted to rotate on itself (generally in idle mode) around its own axis.

The unwinding arrangement 580 may also comprise a cutting device 620, which is adapted to cut the covering tape 800 unwinding from the reel 750, so as to separate a segment thereof.

This cutting device 620 may be operatively positioned between the actuation device 585 and the second support shaft 535 on which the tubular support 705 is mounted.

Operatively positioned means that the cutting device 620 is adapted to operate on a stretch of the covering tape 800 comprised between the actuation device 585 and the second support shaft 535 (i.e., the tubular support 705).

In particular, the cutting device 620 may be operatively positioned at the exit zone of the unwinding arrangement 580, for example between the actuation device 585 and the support rollers 615, so as to operate on a stretch of the covering tape 800 oriented parallel to the advancement direction X.

The cutting device 620 can comprise a blade 625, for example a rotating blade, and actuator members 630 adapted to move said blade 625 with respect to the covering tape 800 unwinding from the reel 750.

In particular, the blade 625 can be driven for moving in a sliding direction parallel to the covering tape 800 but transversal, typically orthogonal, with respect to the advancement direction X with which said covering tape 800 unwinds from the reel 750.

For example, the sliding direction of the blade 625 may be parallel to the rotation axis A" of the second support shaft 535.

In this way, the sliding of the blade 625 allows the covering tape 800 to be cut through along its entire width, subdividing it into two separate segments.

The actuator members 630 of the blade 625 can comprise a cylinder/piston arrangement of the pneumatic type or any other device, for example electromechanical, adapted to impose a linear type movement on the blade 625.

To enable effective cutting of the covering tape 800, the unwinding arrangement 580 may also comprise a blocking device 635 operatively arranged between the first support shaft 505 on which the reel 750 is mounted and the cutting device 620.

Operatively arranged means that the blocking device 635 is adapted to act on a stretch of the covering tape 800 which is comprised between the first support shaft 505 (i.e., the reel 750) and the cutting device 620.

In particular, the blocking device 635 may be operatively interposed between the cutting device 620 and the actuation device 585, preferably in proximity to the blade 625, where it is adapted to stably block the covering tape 800 to allow/favour the cutting action by the blade 625.

This blocking device 635 may comprise a pair of plates 640, flat and mutually opposed, which are arranged parallel to each other and parallel to the rotation axis A" of the second support roller 535 and between which the covering tape 800 unwinding from the reel 750 passes.

These plates 640 can be associated with actuator members (not visible) adapted to engage them in a relative movement, for example in a direction orthogonal to the covering tape 800, between a distanced configuration and a neared configuration.

This relative movement can be obtained for example by keeping one of the two plates 640 stationary and by moving the other towards/away from the first one.

When the plates 640 are in a distanced configuration, the covering tape 800 passes through them with a certain clearance, thus resulting free to slide.

On the other hand, when the plates 640 are in a neared configuration, the covering tape 800 is stably blocked and tightened between the plates 640, which prevent it from advancing.

The actuator members of the plates 640 can comprise a cylinder/piston arrangement of the pneumatic type or any other device suitable for the purpose, for example of the electromechanical type.

As anticipated above, a gap in which the covering tape 800 can pass freely but with preferably reduced clearance remains defined between the plates 640 in a distanced configuration.

In this configuration, the plates 640 thus also act as a guide for the covering tape 800 in the advancement direction X.

In this regard, the plates 640 may therefore be oriented parallel to the advancement direction X and the gap between them may be aligned, along the same advancement direction X, with the gap defined between the support rollers 615 and/or between the drive roller 590 and the contrast roller 600 in a distanced configuration.

In some embodiments, however, the support rollers 615 may be absent and the covering tape 800, at the exit zone of the unwinding arrangement 580, may be guided by the plates 640 only associated with the blocking device 635.

Between the first support shaft 505 carrying the reel 750 and the actuation device 585, the unwinding arrangement 580 may then comprise one or more return rollers, which are adapted to guide the covering tape 800 unwinding from the reel 750 in a predetermined path, more or less long and tortuous, before reaching the actuation device 585 and from here the tubular support 705 mounted on the second support shaft 535.

These return rollers may also have rotation axes parallel to the rotation axis A" of the second support shaft 535.

Figure 7:
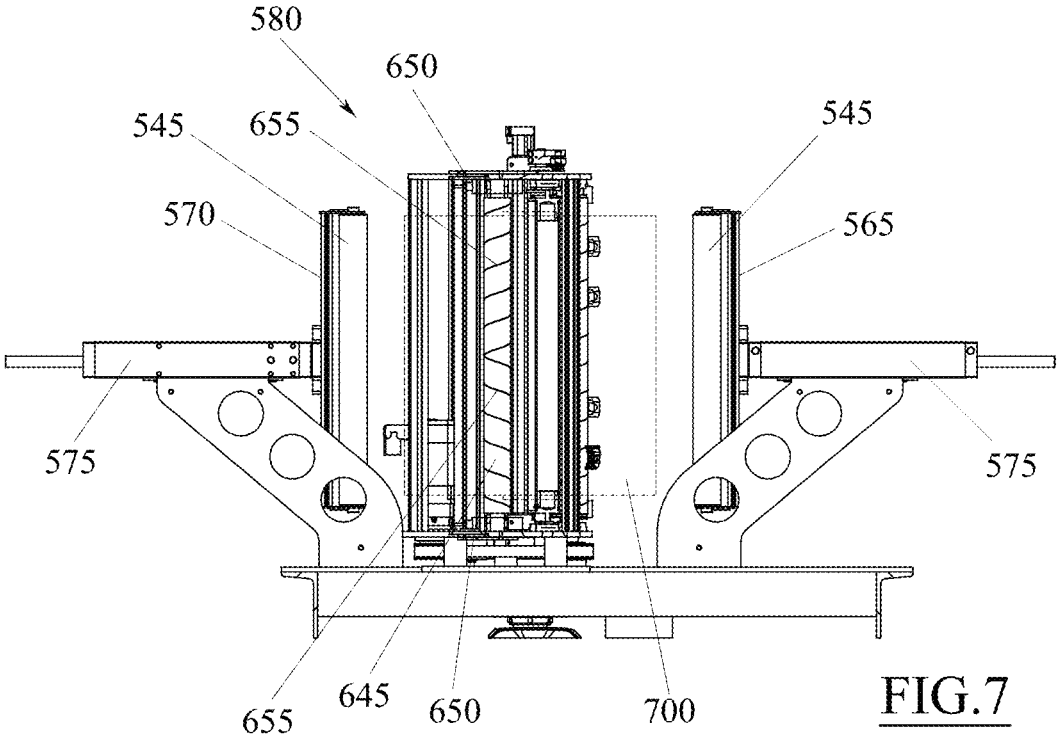
FIG. 7 is the section VII-VII indicated in FIG. 4.

One or more force sensors 650, for example load cells, may be associated with at least one of these return rollers, for example the one indicated with 645, and which are adapted to measure the force that the covering tape 800 exerts on said return roller 645 (see FIG. 7).

In particular, two force sensors 650 positioned at the opposite axial ends of the return roller 645 and adapted to connect them to a structural frame of the un-winding arrangement 580 may be provided.

These force sensors 650 may be connected with an electronic control unit (not illustrated), which may in turn be connected with motors 530 and 540 that drive the first and second support shaft 505 and 535, respectively.

In this way, by measuring the force that is discharged on the return roller 645, the electronic control unit can determine the tension of the covering tape 800 that winds around it and, based on this, adjust the speed of the first and second support shaft 505 and 535, so as to maintain said tension within a range of optimal values.

At least one of said return rollers, for example the same return roller 645 to which the force sensors 650 are associated, may further be grooved by two helical channels 655 extending from a central stretch of the return roller towards opposite axial ends thereof.

In particular, these two helical channels 655 have opposite helix directions, e.g., left-handed and right-handed, respectively.

In this way, the rotation of the return roller 645, caused by the sliding of the covering tape 800 on it, causes these two helical channels 655 to behave as screws which tend to drag the covering tape 800 laterally outwards, i.e., towards the opposite ends of the return roller 645, preventing the same from forming wrinkles.

The unwinding arrangement 580 may further comprise an elongated and curved body 660, which is adapted to be lapped and partially wound by the covering tape 800 unwinding from the reel 750, for example in a stretch comprised between two return rollers.

Figure 8:
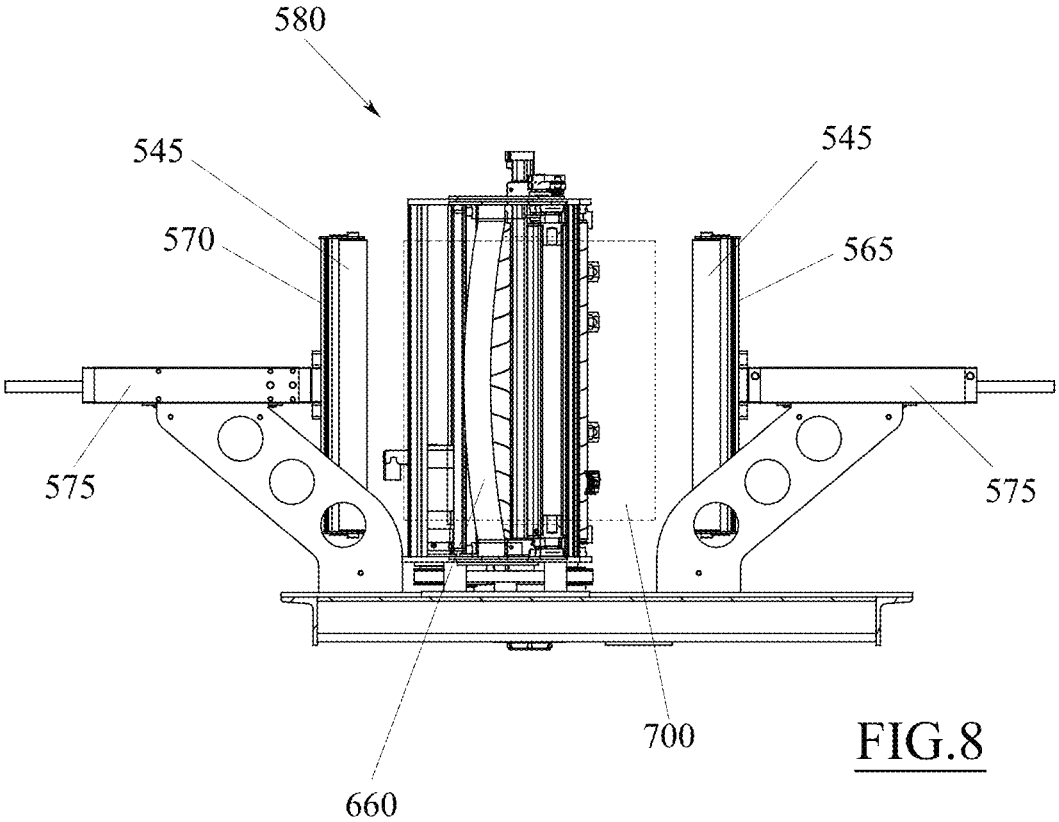
FIG. 8 is the section VIII-VIII indicated in FIG. 4.

This curved body 660, which may be defined by a substantially cylindrical tube, has a substantially curved shape with two opposite axial ends substantially aligned along an axis parallel to the axis A' of the first support shaft 505 and a central portion which is misaligned with respect to said axis (see FIG. 8).

The curved body 660 is preferably rigidly fixed and is not able to rotate.

In this way, the covering tape 800 coming into contact with this curved body 660 locally assumes the same curved shape as the latter, which tends to counteract any possible displacement of the covering tape 800 in a direction parallel to the axis A' of the first support shaft 505, contributing to keeping the covering tape 800 centred within the unwinding arrangement 580, that is, substantially coplanar to the reel 750.

Finally, the machine 500 may have one or more blower devices 665 adapted to emit high pressure air jets, which are adapted to guide the free end of the covering tape 800 unwinding from the reel 750 towards the tubular support 705 mounted on the second support shaft 535, keeping it substantially flat and parallel to the rotation axis A" of the second support shaft 535.

To achieve this purpose, each blower device 665 is arranged so that the air jet generated therefrom is directed into a space comprised between the second support shaft 535 and the end zone of the unwinding arrangement 580, for example between the second support shaft 535 and the actuation device 585, that is between the second support shaft 535 and the cutting device 620 or, more preferably, between the second support shaft 535 and the support rollers 615 (if any).

Each blower device 665 may further be arranged so that the air jet generated therefrom is inclined and incident with respect to the advancement direction X imparted to the covering tape 800 and preferably in a manner concordant with the latter, i.e., having at least one component directed in the same direction.

In particular, the machine 500 may comprise at least two of these blower devices 665 arranged on opposite sides with respect of the covering tape 800 sliding in the advancement direction X and oriented so that the respective air jets converge towards each other.

Preferably, each blower device 665 is configured such that the air jet generated therefrom assumes the conformation of an air blade, oriented in a plane substantially parallel to the axis A" of the second support shaft 535 and extending preferably at least throughout the entire width of the covering tape 800.

To achieve this air blade, each blower device 665 may comprise a single suitably shaped nozzle or a series of suitably arranged nozzles.

The blower devices 665 may be installed on the unwinding arrangement 580, for example on a structural frame thereof.

Figure 9:
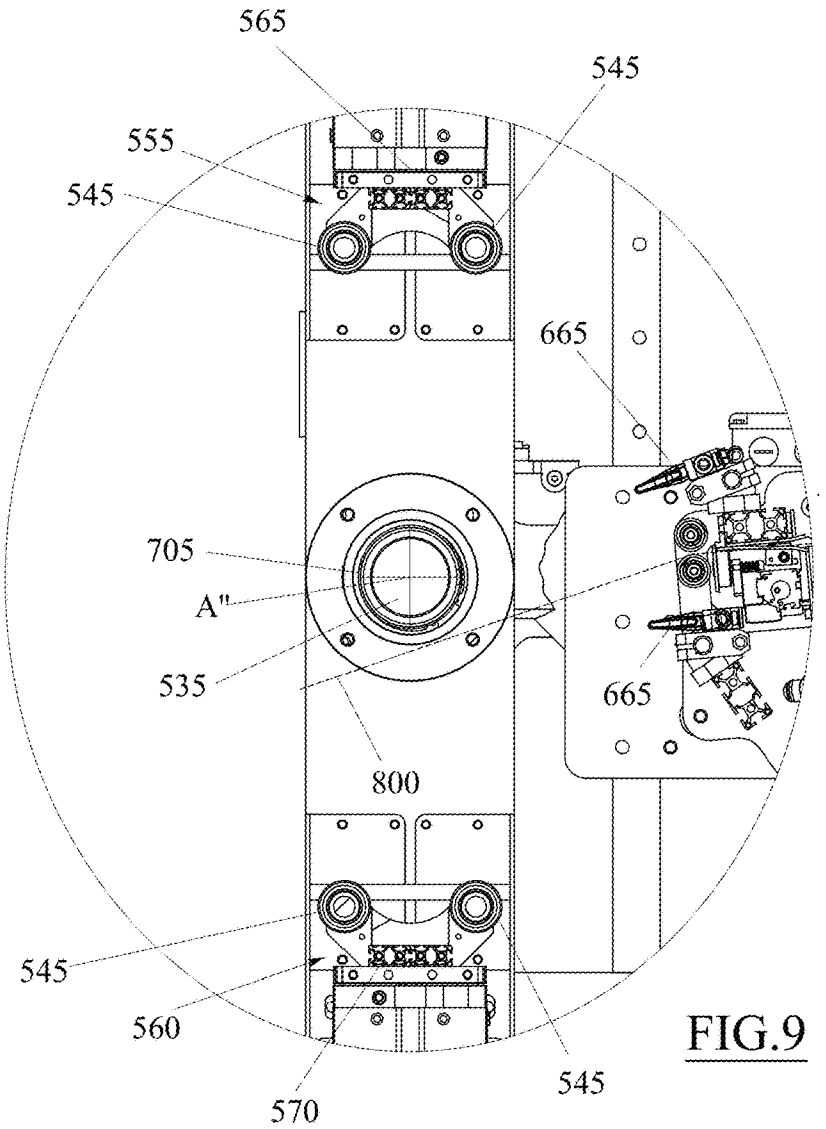

In the light of what has been described, the operation of the machine 500 essentially envisages that a reel 750 is coaxially coupled and blocked to the first support shaft 505 and that a tubular support 705 (empty) is coaxially coupled and blocked to the second support shaft 535, while the contrast rollers 545 are not in a neared configuration but are more distanced from the axis A" of the second support shaft 535, for example as illustrated in FIG. 9.

At this point, the free end of the support tape 800 of the reel 750 is inserted into the unwinding arrangement 580, by making it pass between the drive roller 590 and the contrast roller 600 of the actuation device 585 and, optionally, between the plates 640 of the blocking device 635, which clamp it.

By operating the actuation device 585, possibly assisted by the rotation of the first support shaft 505, the free end of the covering tape 800 is then advanced in the advancement direction X, until it protrudes from the unwinding arrangement 580, in the space comprised between the latter and the second support shaft 535.

In this zone, the free end of the covering tape may be supported, directed and kept substantially stretched by the air jets generated by the blower devices 665, so that, as the advancement continues, it is positioned between the tubular support 705 mounted on the second support shaft 535 and at least one of the contrast rollers 545.

At this point, the contrast rollers 545 are brought into the neared position, so as to clamp the aforesaid free end of the covering tape 800 against the tubular support 705 (see FIG. 10).

Immediately thereafter, the second support shaft 535 is put in rotation so that the support tape 800, as it continues to unwind from the reel 750, begins to wind onto the tubular support 705.

As the number of turns of covering tape 800 wound around the tubular support 705 increases, the contrast rollers 545 are moved away from the second support shaft 535, while ensuring a certain pressure adapted to keep the turns folded and taut (see FIG. 11).

During this step, the drive roller 590 and the contrast roller 600 of the actuation device 585 are preferably brought into a distanced configuration, so that the un-winding and rewinding of the covering tape 800 is delegated solely to the rotation of the first and second support shaft 505 and 535.

At the same time, the electronic control unit monitors the tension of the covering tape 800 by means of the force sensors 650 and adjusts the speed of the first and second support shaft 505 and 535 (by means of the respective motors), so that this tension remains within the optimal range of values.

When a roll 710 of covering tape having a desired size has been obtained on the tubular support 705, the rotation of the first and second support shaft 505 and 535 is stopped and the cutting device 620 proceeds to cut the support tape 800. Subsequently (see FIG. 12), the reel 700 can be unblocked and removed from the second support shaft 535, in order to be eventually brought, for example by means of a special equipment, to the magazine 425, on which it can be arranged in order to be taken by the winding machine 100.

In the meantime or thereafter, a new tubular support 705 (empty) may be fitted and blocked onto the second support shaft 535 of the machine 500 to make another reel 700 in the same manner as outlined above.

Obviously, an expert in the field may make several technical-applicative modifications to all that above, without departing from the scope of the invention as hereinbelow claimed.

The invention claimed is:

1. A machine for unwinding and rewinding a covering tape, comprising:

a first support shaft adapted to receive coaxially a reel of covering tape, a second support shaft, parallel to and distanced from the first support shaft, which is adapted to coaxially receive a tubular support, a motor adapted to put the second support shaft in rotation around its own axis (A"), a plurality of contrast rollers arranged around the second support shaft and oriented parallel thereto, and a movement apparatus adapted to move the contrast rollers towards and away from the axis (A") of the second support shaft, wherein said movement apparatus comprises:

a first frame adapted to carry at least one of said contrast rollers, a second frame adapted to carry the remaining contrast rollers, and actuation members to move said first frame and said second frame in opposite directions along a same sliding direction (Q) orthogonal to the axis (A") of the second support shaft.

2. The machine according to claim 1, wherein the contrast rollers are equidistant with respect to the axis (A") of the second support shaft.

3. The machine according to claim 1, comprising:

a first pair of said contrast rollers, arranged symmetrically with respect to a first plane of symmetry (P1) containing the axis (A") of the second support shaft, and a second pair of said contrast rollers, arranged symmetrically to the first pair contrast rollers with respect to a second plane of symmetry (P2) containing the axis (A") of the second support shaft and orthogonal to the first plane of symmetry (P1).

4. The machine according to claim 3, wherein the first pair of contrast rollers is carried by the first frame and the second pair of contrast rollers is carried by the second frame, and wherein the sliding direction (Q) is parallel to the first plane of symmetry (P1).

5. The machine according to claim 1, comprising a motor adapted to put the first support shaft in rotation around its own axis (A').

6. The machine according to claim 1, comprising a plurality of return rollers oriented parallel to the first support shaft for guiding the covering tape between the reel and the tubular support, at least one of which is associated with at least one force sensor (adapted to measure the force exerted on it by the covering tape.

7. The machine according to claim 6, wherein at least one of said return rollers is grooved by two helical channels extending from a central stretch of said roller towards the opposite axial ends thereof with opposite helix directions.

8. The machine according to claim 1, comprising a curved body adapted to stay in contact with the covering tape un-winding from the reel, which has two opposite axial ends aligned along a common axis parallel to the axis (A') of the first support shaft and a central portion misaligned with respect to said common axis.

9. The machine according to claim 1, comprising a cutting device for separating the covering tape from the reel.

10. The machine according to claim 9, wherein said cutting device comprises:

a blade, a blocking device operatively positioned between the blade and the first support shaft, to selectively block the covering tape unwinding from the reel, and actuator members adapted to move said blade transversely with respect to the covering tape.

11. The machine according to claim 1, comprising an actuation device for unwinding the covering tape from the reel and making the covering tape advance towards the second support shaft.

12. The machine according to claim 11, wherein said actuation device comprises:

a motorised drive roller having a rotation axis (B) parallel to the axis (A") of the second support shaft, a contrast roller having a rotation axis (C) parallel to the rotation axis (B) of the drive roller, and actuator members adapted to create a relative movement of said drive roller and said contrast roller transversally with respect to the respective rotation axes (B, C) between a distanced configuration, in which between the drive roller and the contrast roller a gap is defined, adapted to be crossed with clearance by the covering tape unwinding from the reel, and a neared configuration, in which the drive roller and the contrast roller are adapted to clamp said covering tape.

13. The machine according to claim 1, comprising at least one blower device adapted to emit an air jet into a space comprised between first and second support shaft.

14. A method for unwinding and rewinding a covering tape by a reeling machine wherein the reeling machine comprises:

a first support shaft adapted to receive coaxially a reel of covering tape, a second support shaft, parallel to and distanced from the first support shaft, which is adapted to coaxially receive a tubular support, a motor adapted to put the second support shaft in rotation around its own axis (A"), a plurality of contrast rollers arranged around the second support shaft and oriented parallel thereto, and a movement apparatus adapted to move the contrast rollers towards and away from the axis (A") of the second support shaft, and wherein the method comprises the steps of:

fitting a reel of covering tape coaxially onto the first support shaft, fitting a tubular support coaxially onto the second support shaft, fitting one free end of the covering tape of the reel between the tubular support and at least one of the contrast rollers, bringing the contrast rollers closer to the axis (A") of the second support shaft, so as to tighten said free end against the tubular support, putting the second support shaft in rotation, and as the covering tape winds onto the tubular support, progressively moving the contrast rollers away from the axis (A") of the second support shaft, while keeping each one of the contrast rollers in contact with the covering tape wound on the tubular support.

15. A machine for unwinding and rewinding a covering tape, comprising:

a first support shaft adapted to receive coaxially a reel of covering tape, a second support shaft, parallel to and distanced from the first support shaft, which is adapted to coaxially receive a tubular support, a motor adapted to put the second support shaft in rotation around its own axis (A"), a plurality of contrast rollers arranged around the second support shaft and oriented parallel thereto, and a movement apparatus adapted to move the contrast rollers towards and away from the axis (A") of the second support shaft and adapted to bring the contrast rollers closer to the axis (A") of the second support shaft up to a neared configuration in which the contrast rollers are all contemporarily at the same distance from the axis (A") of the second support shaft.

16. The machine according to claim 15, wherein the contrast rollers in the neared configuration are all contemporarily in contact with the tubular support.

* * * * *